US008322724B2

(12) United States Patent
Miller, Jr.

(10) Patent No.: US 8,322,724 B2
(45) Date of Patent: Dec. 4, 2012

(54) TABLETOP SPORTING GAME APPARATUS

(75) Inventor: Robert Lamoine Miller, Jr., Canton, OH (US)

(73) Assignee: Robert L. Miller, Jr., Canton, OH (US)

( * ) Notice: Subject to any disclaimer, the term of this patent is extended or adjusted under 35 U.S.C. 154(b) by 229 days.

(21) Appl. No.: 12/847,332

(22) Filed: Jul. 30, 2010

(65) Prior Publication Data

US 2011/0031691 A1 Feb. 10, 2011

Related U.S. Application Data

(60) Provisional application No. 61/232,477, filed on Aug. 10, 2009.

(51) Int. Cl.
*A63F 7/06* (2006.01)

(52) U.S. Cl. ..... 273/317.3; 273/317.5; 273/108.4; 273/108.55

(58) Field of Classification Search ..... 273/108–108.57, 273/317.3, 317.5, 129 R, 129 V, 129 W, 259, 273/340

See application file for complete search history.

(56) References Cited

U.S. PATENT DOCUMENTS

| | | | | | |
|---|---|---|---|---|---|
| 935,585 | A * | 9/1909 | Campbell | 273/317.1 |
| 1,116,593 | A * | 11/1914 | Johnson | 273/317.3 |
| 1,703,240 | A * | 2/1929 | Jacobson | 273/108.4 |
| 3,088,737 | A * | 5/1963 | Boone | 273/317.1 |
| 3,685,829 | A * | 8/1972 | Barlow | 273/357 |
| 3,781,010 | A * | 12/1973 | Matsumoto | 273/317.3 |
| 3,782,726 | A * | 1/1974 | Huffman et al. | 273/108.41 |
| 3,834,701 | A * | 9/1974 | Hashimoto | 273/317.3 |
| 3,958,806 | A * | 5/1976 | Brown | 273/317.3 |
| 4,872,679 | A * | 10/1989 | Bohaski et al. | 273/317.5 |
| 5,186,119 | A * | 2/1993 | Hlavin | 116/222 |
| 6,776,414 | B1 * | 8/2004 | Messac | 273/284 |
| 2004/0160011 | A1 * | 8/2004 | Fitzgerald | 273/317.3 |

* cited by examiner

*Primary Examiner* — Sebastiano Passaniti

(74) *Attorney, Agent, or Firm* — Krugliak, Wilkins, Griffiths & Dougherty Co., L.P.A.; David P. Dureska; Brent L. Moore

(57) ABSTRACT

A portable tabletop sporting game apparatus includes a game board having at least one opening formed therein. A pair of legs are attached to the game board in order to elevate the game board generally off of the ground. A lever is operatively attached to an underside of the game board and in communication with a man game piece. The man game piece is disposed through the game board opening, such that when the lever is depressed, the man game piece is forced upwardly through the game board opening in order to block or lift a ball, which is being pushed, moved or nudged across the game board.

17 Claims, 12 Drawing Sheets

TABLETOP SPORTING GAME APPARATUS

CROSS-REFERENCE TO RELATED APPLICATION

This application claims the benefit of U.S. Provisional Application No. 61/232,477, filed on Aug. 10, 2009.

BACKGROUND OF THE INVENTION

1. Field of the Invention

The invention relates generally to the art of tabletop sporting games and more particularly pertains to a tabletop sporting game that utilizes a ball, which is pushed or slid across a tabletop game hoard or field in order to place the ball at a desired location. The tabletop game field includes multiple levers, each one of the levers communicating with a man game piece, whereby when the lever is depressed, the man game piece is forced up through an opening in the game board or field surface in order to block, lift or otherwise alter the path of the sliding ball.

2. Description of Related Art

Various games require application of a player's skill in determining the relative effects of inertia and friction to place a sliding puck or game piece at a predetermined location. Most of these games require either a fixed court or an extremely large non-portable table, which restricts the play of such inertia/friction games to a fixed location. Because they are not portable, they are generally not useful for play during unexpected leisure time.

In addition, sporting games such as football, soccer and hockey, while extremely popular, can normally not be played inside because of the size of the field required. Football, for example requires a 100-yard field and a relatively large leather football. Because of these play restrictions due to the size of the required playing field, various types of tabletop simulated football games have been known in the art. By way of example, U.S. Pat. No. 5,570,888 provides a thumb football game and apparatus, which pertains to a tabletop football game in which a simulated football is thumped by the finger of a player on a tabletop simulated football field. U.S. Pat. No. 5,323,865 provides an amusement game with a simulated playing field and a toy football made of soft material.

These tabletop games, although portable and generally fun to play, fail to provide a true-to-life game experience, which game experience includes the ire of the coach, the exuberance of a player and the anticipation of a fan all rolled into one.

The apparatus for a tabletop sporting game of the present invention overcomes the problems associated with the prior art and provides a portable gaming apparatus which includes both offensive and defensive structural components in order to provide a true-to-life gaming experience for the player of the tabletop sporting game apparatus.

BRIEF SUMMARY OF THE INVENTION

The objectives of the present invention include providing a portable tabletop sporting game apparatus that is easy to use and provides fun and enjoyment to the player of the game.

Another objective of the present invention is to provide a portable tabletop sporting game apparatus that includes a plurality of openings in the playing surface, through which man game pieces can be forced upwardly in order to block or defend the ball, which is put into play by another player.

Yet another objective of the present invention is to provide a novel lever and lever attachment device for a tabletop sporting game apparatus that is capable of being activated in order to raise the man game pieces through the openings in the game board surface.

Still another objective of the present invention is to provide a tabletop sporting game apparatus that is capable of simulating a more true-to life game experience.

These objectives and improvements are provided by the tabletop sporting game apparatus of the present invention which includes a game board having at least one opening formed therein, a pair of legs being attached to the game board, the legs elevating the game board generally off of the ground, a lever operatively attached to an underside of the game board and in communication with a man game piece, the man game piece being disposed through the game board opening, such that when the lever is depressed, the man game piece is forced upwardly through the game board opening in order to affect a movement of a ball being moved across the game board.

BRIEF DESCRIPTION OF THE SEVERAL VIEWS OF THE DRAWINGS

An exemplary embodiment of the present invention, illustrative of the best mode in which Applicant has contemplated applying the principles, is set forth in the following description and is shown in the drawings.

Similar numerals refer to similar parts throughout the drawings.

DETAILED DESCRIPTION OF THE INVENTION

Figure 1:
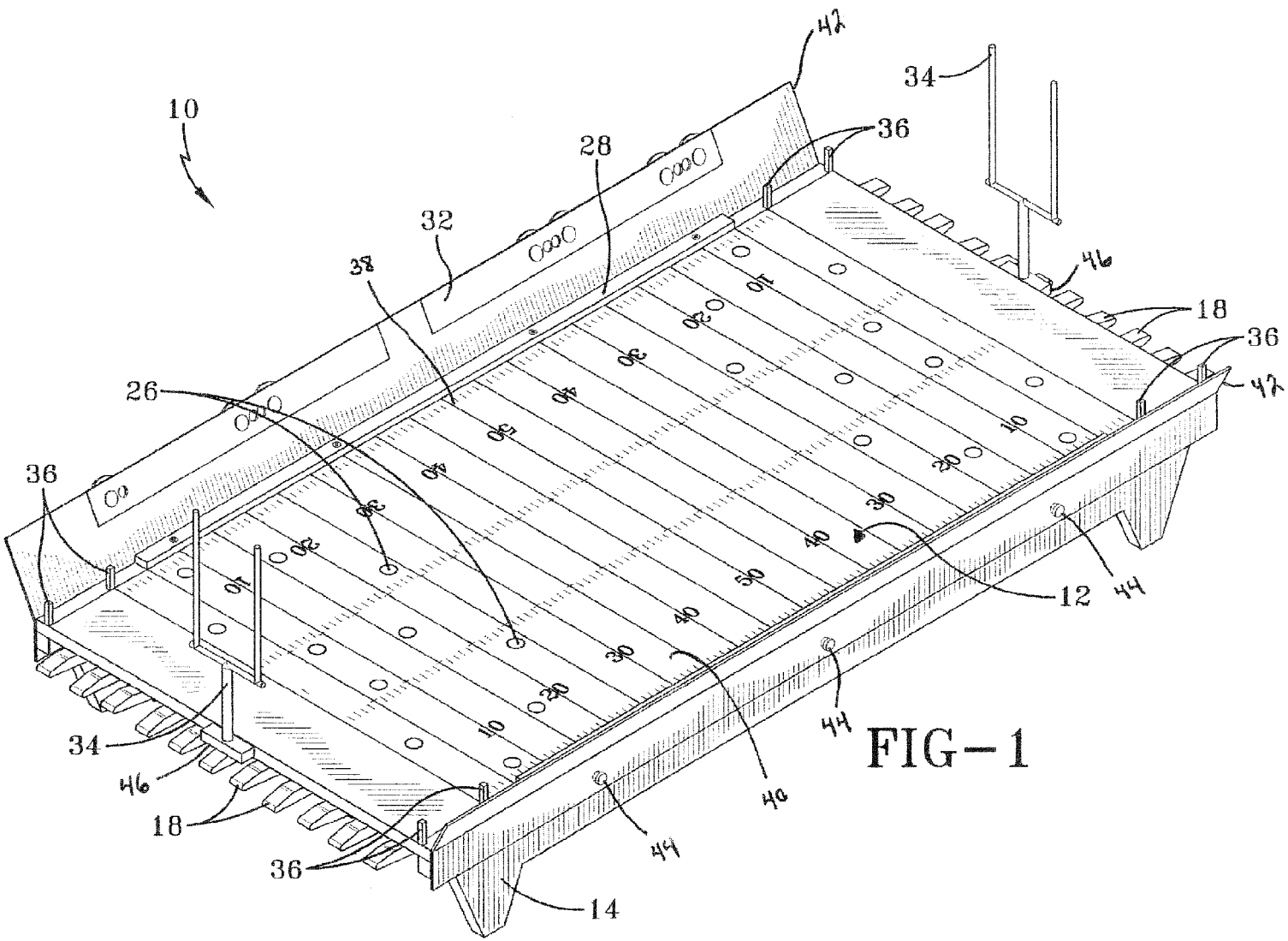
FIG. 1 is a top perspective view of the tabletop sporting game apparatus of the present invention, showing the openings formed in the surface of the game board, the score board, a pair of goal posts and a plurality of levers protruding from each end of the game board apparatus.
Figure 2:
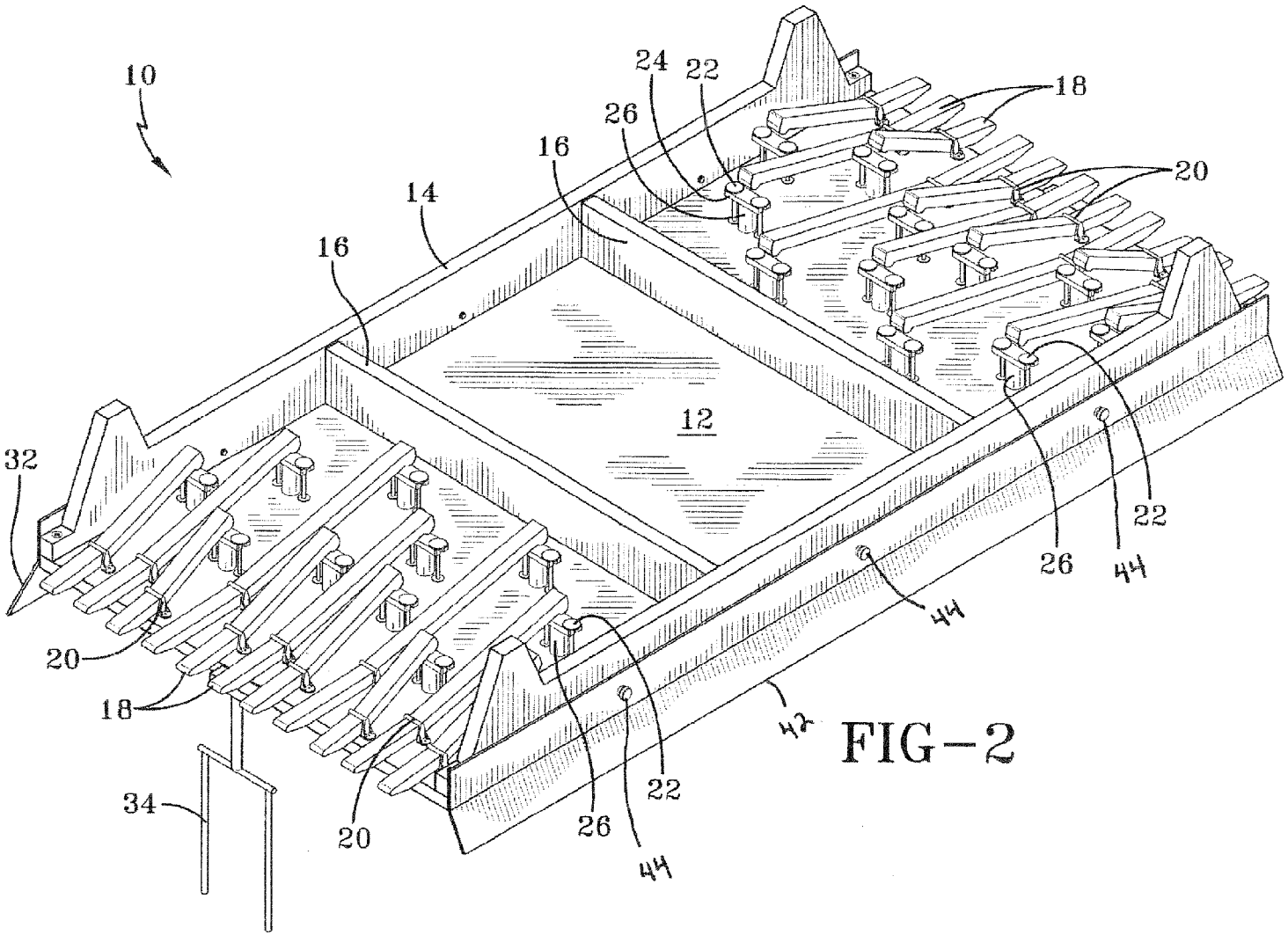
FIG. 2 is a top perspective view of the underside of the tabletop sporting game apparatus of the present invention, showing the plurality of levers operatively mounted on the underside of the game surface by respective saddles and being operatively positioned to force the man game pieces up through the openings in the game board when the lever is depressed.
Figure 3:
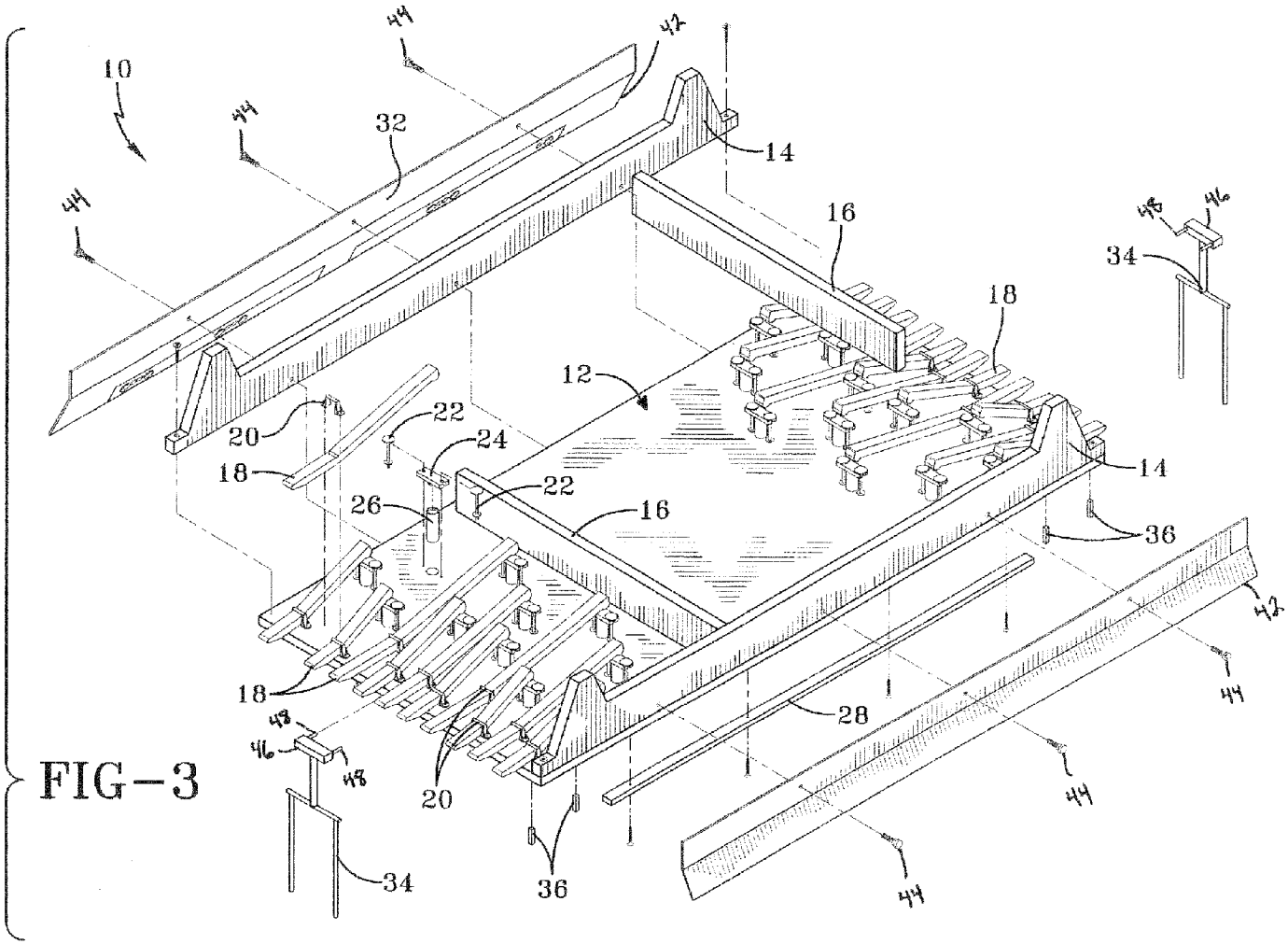
FIG. 3 is an exploded view of the tabletop sporting game apparatus of the present invention shown in FIG. 2.
Figure 4:
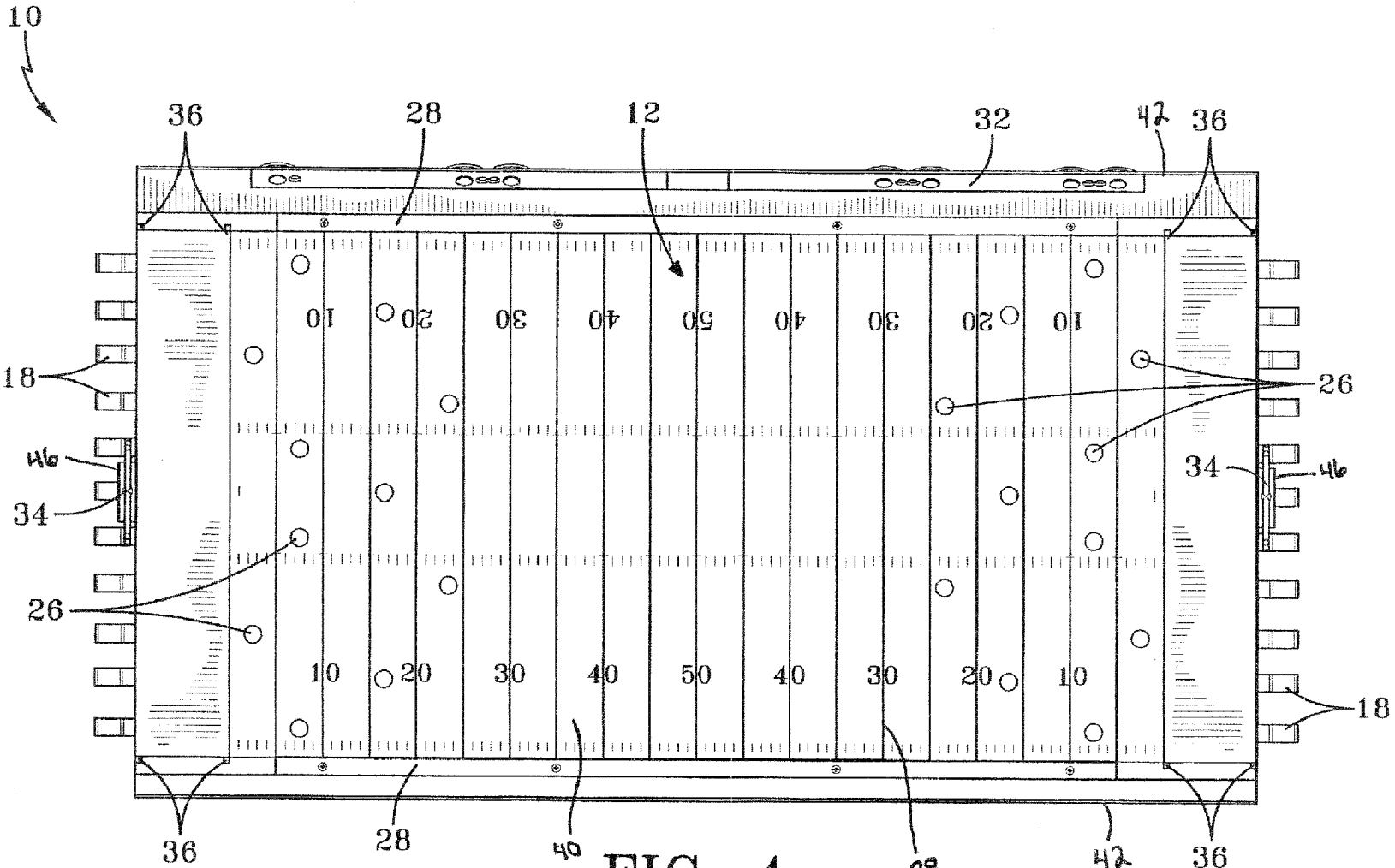
FIG. 4 is a top view of the tabletop sporting game apparatus of the present invention, showing the American football indicia printed on the game board surface, the bumpers and the plurality of levers extending from each side of the game board.
Figure 5:
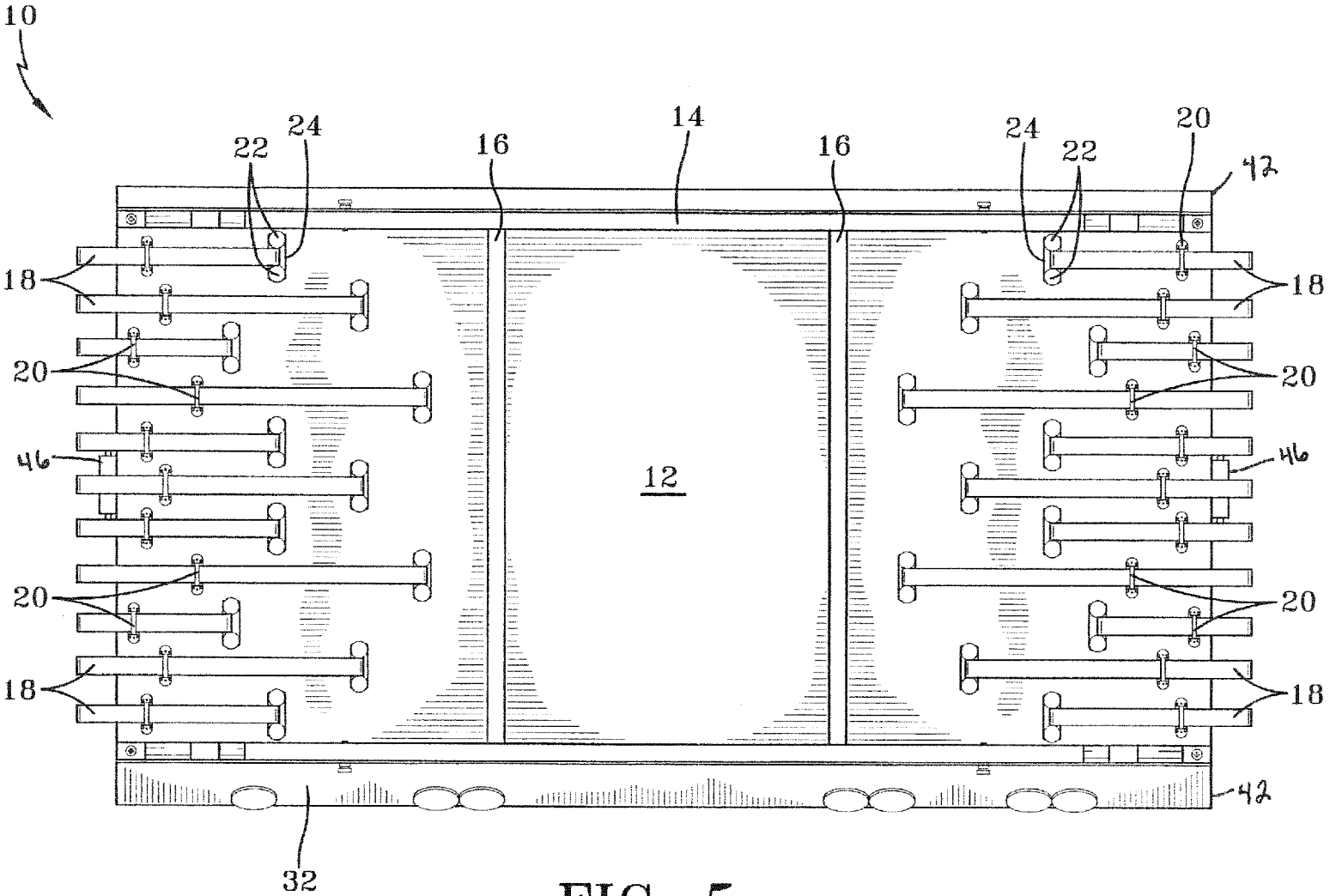
FIG. 5 is a bottom view of the tabletop sporting game apparatus of the present invention, showing the plurality of levers, each lever being operatively mounted on the game board by a saddle and also being operatively positioned under the base of the man game piece in order to force the man game piece through the opening in the game board.
Figure 6:
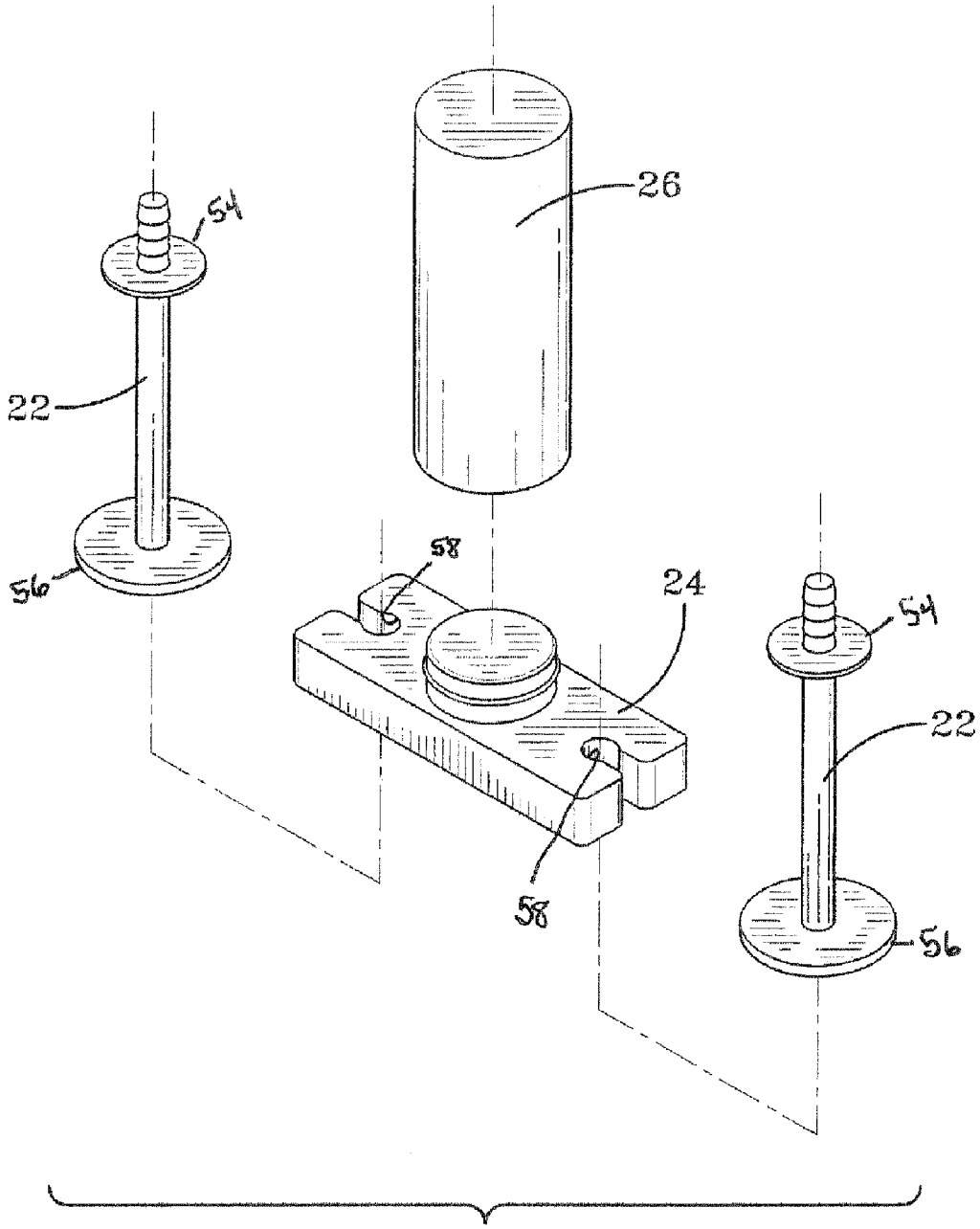
FIG. 6 is a greatly enlarged exploded view of the man base, man game piece, and pair of pins shown in FIG. 3.
Figure 7A:
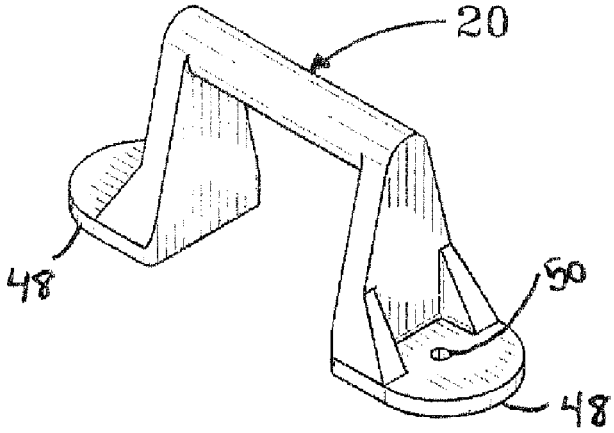
FIG. 7A is a top perspective view of the saddle shown in FIG. 6.
Figure 7B:
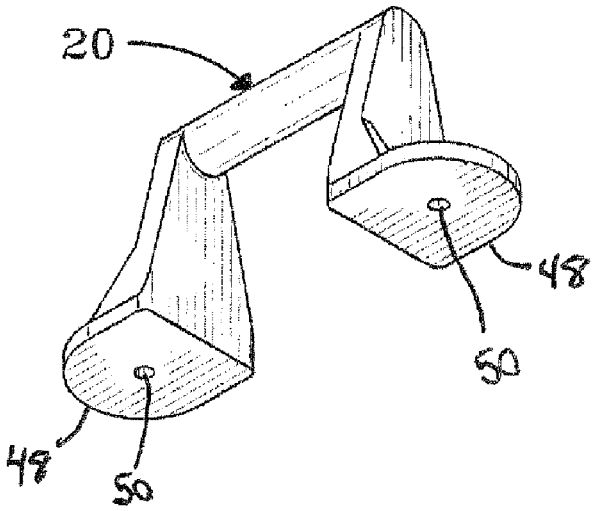
FIG. 7B is a bottom perspective view of the saddle shown in FIG. 6.
Figure 8:
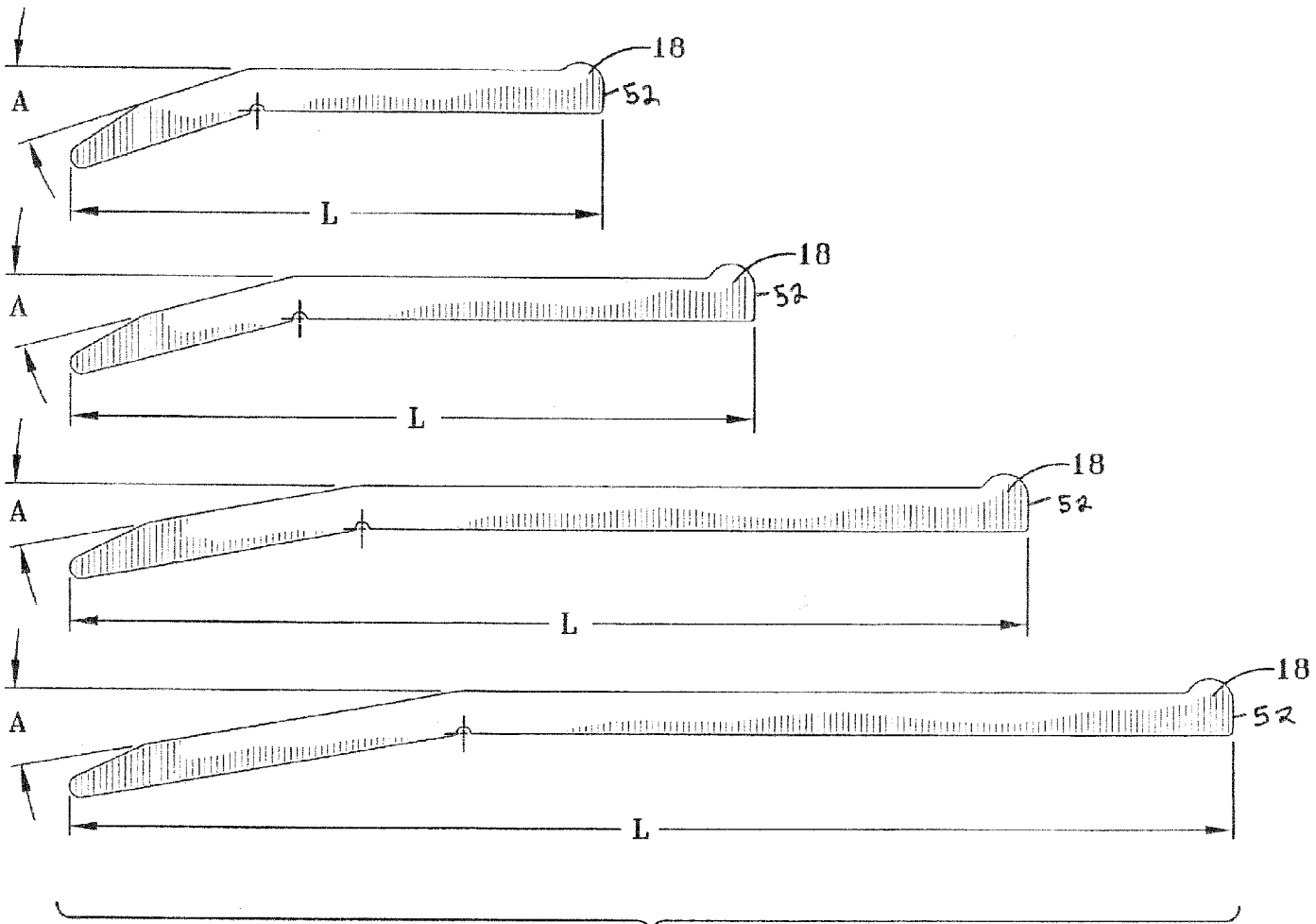
FIG. 8 is an elevational view of each of the levers shown in FIG. 3, showing the differing lengths of the several levers.
Figure 9A:
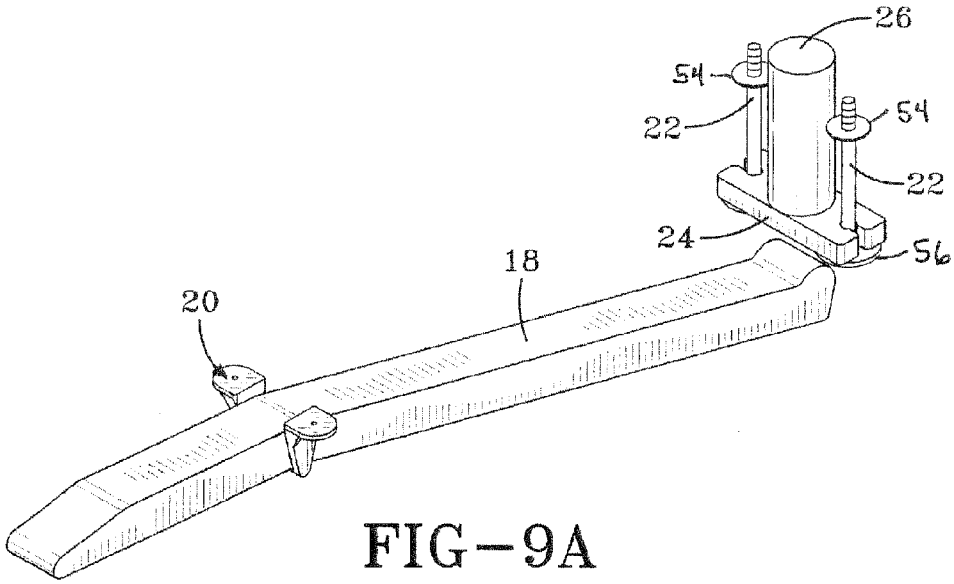
FIG. 9A is a top perspective view of the lever, saddle, pins and man game piece shown in FIG. 3 isolated from the apparatus of the present invention.
Figure 9B:
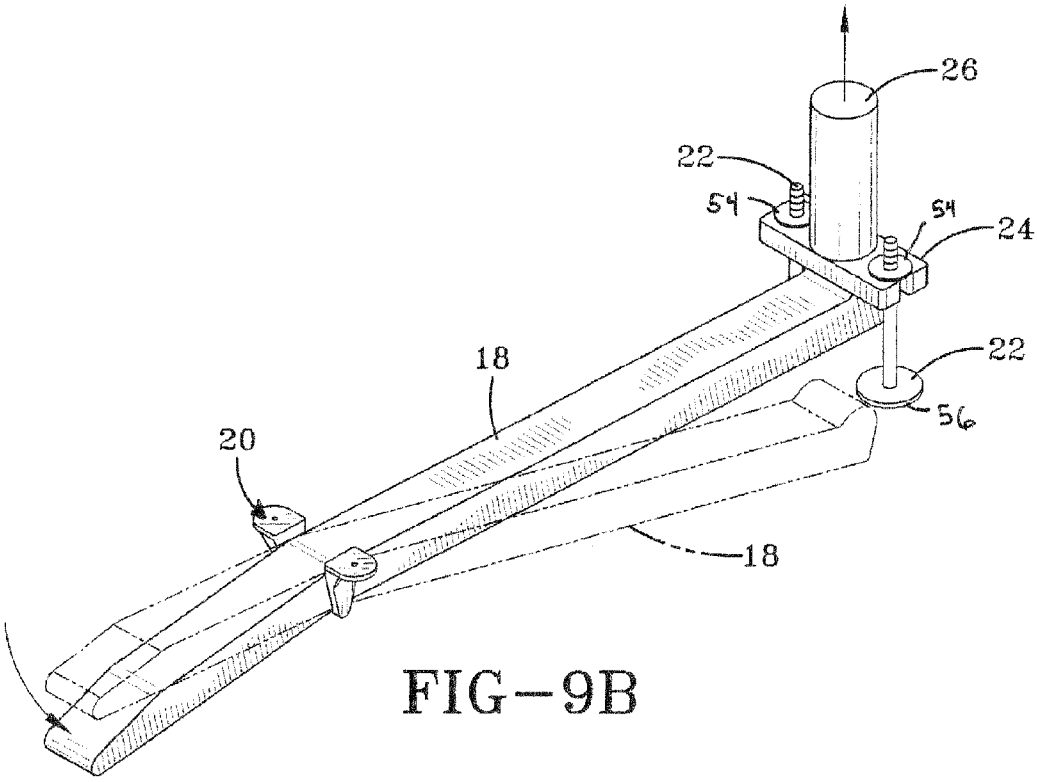
FIG. 9B is a view similar to FIG. 9A, showing the movement of the base and the man game piece along pins 22 when the lever is depressed in a downward direction.
Figure 10A:
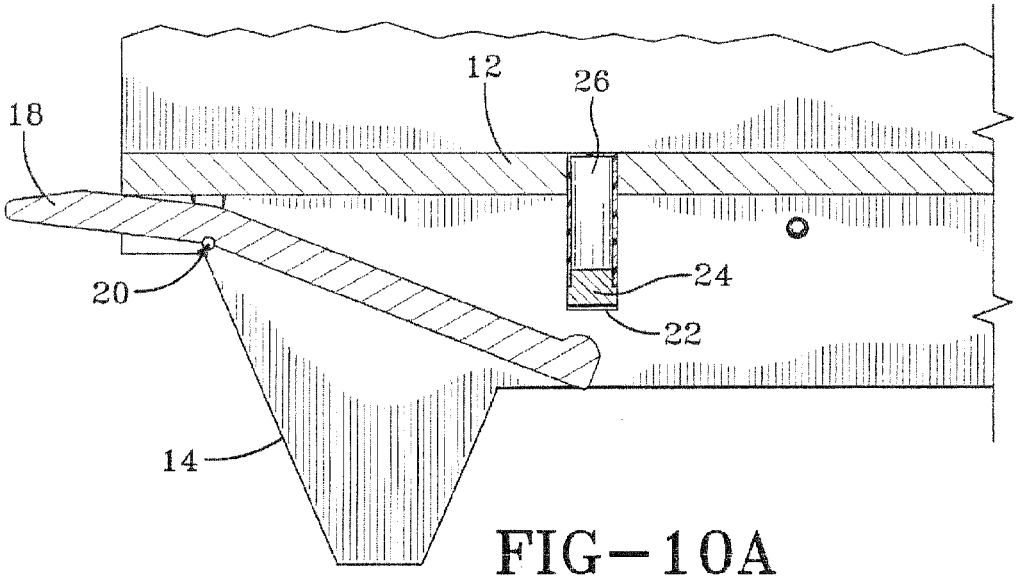
FIG. 10A is an elevational view of the lever shown in FIGS. 9A and 9B mounted on the tabletop sporting game apparatus of the present invention with the lever in the neutral or non-activated position.
Figure 10B:
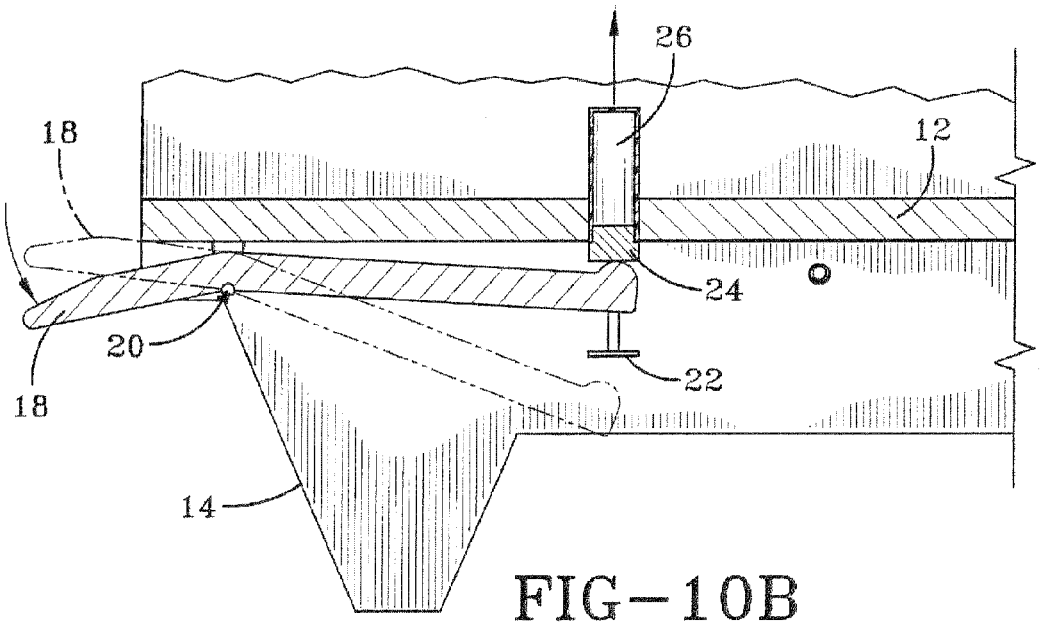
FIG. 10B is a view similar to FIG. 10A, but showing the lever depressed or activated in a downward direction and the base and the man game piece moving upwardly with the man game piece extending through the opening in the game surface.

Turning now to FIGS. 1-5, a preferred embodiment of a tabletop sporting game apparatus of the present invention is shown generally at reference numeral 10 and will be described in detail below. Game apparatus 10 includes a rectangular-shaped planer game board 12, which is generally sized length to width in a 2:1 ratio. For example, the length of the game board is 48.0 inches and the width of the game board is 24.0 inches. Of course, other ratios such as from about 1-3:1 could also be utilized without changing the overall concept of the present invention. Game board 12 is formed from a rigid material such as wood, plastic, metal, mdf or other similar material. A Formica® or melamine top surface 40 is adhered or bonded to the top of game board 12. Game board top surface 40 is preferably screen printed with American football field indicia 38. A paper backer 26 is adhered or bonded to the underside of game board 12 in a manner well known to those having skill in the art. Game board 12 is formed with a plurality of openings 26 that extend through the entire thickness of the game board. Preferably, game board 12 includes twenty-two openings 26, with eleven of the openings being formed generally at one end of the game board and the other eleven openings being formed generally at the other end of the game board. Game board 12 could also be formed with fewer openings, such as from one to twenty-one openings, or more than twenty-two openings without changing the overall concept of the present invention. Game board openings 26 are preferably round in shape, however, the openings could also be formed into other shapes such as a square, rectangle, triangle, octagon or ellipse or other such shape without changing the overall concept of the present invention. Openings 26 preferably have a diameter of from about 1/16 inch to about 1½ inches, but are most preferably about ¾ inch in diameter. Game board 12 serves as the playing surface for tabletop sporting game apparatus 10.

A pair of longitudinally-extending legs 14 each are rigidly connected to a respective side of game board 12 along the length of the game board by screws or other similar fastening means well known in the art. Legs 14 support game board 12 so that the game board is generally elevated off of the ground. Legs 14 are preferably from about 3.0 inches to about 48.0 inches tall and most preferably from about 5½ inches to about 7.0 inches tall. Legs 14 have a thickness of about ¾ inches. Legs 14 are made of any hard material known in the art, such as wood, metal plastic, and the like. A pair of cross-braces 16 are spaced-apart and extend transversely between respective ones of legs 14. Cross-braces 16 add additional support to game board 12. Cross-braces 16 are formed from any hard material known in the art, such as wood, metal, plastic, and the like. Cross-braces 16 have a generally rectangular cross sectional shape, but other cross-sectional shapes such as a square, triangle, or circle, could be utilized without changing the overall concept of the present invention. Although a pair of cross-braces 16 is preferable, from one to eight of the cross-braces could be utilized without changing the overall concept of the present invention.

A pair of longitudinally-extending bumpers 28 each are rigidly connected to a respective side edge of game board 12 along the length of the game board by screws or other similar fastening means well known in the art. Bumpers 28 serve as a border to game board 12, prohibit a game ball 30 from sliding off the game board side edge, and keep the ball in play on game board top surface 40. Bumpers 28 are formed from any hard material known in the art, such as wood, metal, plastic, and the like. Bumpers 28 are preferably shaped as long thin rectangles but may also take any other shape. Bumpers 28 are preferably between about 12.0 inches and 48.0 inches long, but most preferably are about 36.0 inches in length. Bumpers 28 have a width of about ¾ inch but could also be thinner or wider without changing the overall concept of the present invention. Bumpers 28 have a thickness of about ½ inch, but could also have a thickness of less than or more than ½ inch without changing the overall concept of the present invention.

A scoreboard 32 formed from plastic or other suitable material is mounted on an angled sidewall 42 which is in turn connected to game board 12 and a respective one of legs 14 by fasteners 44. Scoreboard 32 serves to keep score and time for game play. Scoreboard 32 can be as wide as 48.0 inches and as narrow as 6.0 inches. The height of scoreboard 32 is preferably 6.0 inches but the scoreboard could also be taller or shorter without changing the overall concept of the present invention. Scoreboard 32 preferably includes seven scoring dials, however, less than seven or more than seven dials could also be utilized without changing the overall concept of the present invention.

A pair of goal posts 34 each are removably mounted onto respective ends of game board 12 via protuberances 48 (FIG. 3) that are formed in the front surface of a base 46 on which the goal post is fixedly mounted and which fit into pre-drilled openings (not shown) formed in each end of game board 12. The way in which goal posts 34 are mounted allows them to be easily placed and removed during game play. Goal posts 34 serve as a means for scoring extra points or filed goals during game play. Goal posts 34 are made of any rigid material known in the art such as wood, metal or plastic, but are preferably made of plastic. Each goal post 34 is about 11¾ inches tall with uprights and cross bar having a circular cross-section of about ⅜ inch. The post at which the crossbar connects has a circular cross section of about ⅜ inch, but may also be either greater or lesser than ⅜ inch without changing the overall concept of the present invention.

Eight pylons 36 having a generally square cross-sectional shape are removably mounted into like-shaped openings formed in game board 12 as shown in FIG. 1. Pylons 36 serve as a means to mark the beginning and the end of each end zone of the playing surface. Pylons 36 can be made of any pliable or flexible material known in the art but are preferably made of foam. Pylons 36 have a height of about 1.0 inch but may be longer or shorter without changing the overall concept of the present invention. Pylons 36 preferably have a generally square cross-sectional shape, but could also be round or any other shape.

With additional reference to FIGS. 6-10B and in accordance with a primary feature of the present invention, a plurality of levers 18 are each operatively mounted on the underside of game board 12 via a respective one of a plurality of saddles 20. Because the structure and operation of each lever 18 and saddle 20 is similar to the other levers, for sake of clarity and simplicity only one of the levers will be described in detail below. Lever 18 can be between about 2.0 inches and 48.0 inches in length. Preferably, lever 18 is between about 6.0 inches and 15.0 inches in length and each lever aligns with a respective opening 26 formed in game hoard 12. Lever 18 can have a width of about ½ inch to about 1½ inches, but is preferably about ¾ inch wide. Lever 18 can be about ⅛ inch to about ¾ inch thick, but is preferably about ⅝ inch thick. Lever 18 can be angled between 1 degree and 99 degrees, but is preferably angled between about 15 degrees and 40 degrees. Lever 18 can extend about ½ inch to about 4 inches beyond the end of game board 12, but preferably extends about 2.0 inches beyond the end of the game board. The top side of lever 18 rests against the underside of game board 12 when the lever is inactive. Lever 18 is slightly rounded at end 52 so that a man game piece 26 moves smoothly on the end of the lever in a perpendicular fashion to game board 12. Saddle 20 is a generally U-shaped piece having two flanged sections 48 that extend upwardly on either side of the saddle. Each flange 48 is formed with an opening 50 to accommodate a screw (not shown) so that the saddle may be attached to the underside of game board 12. Saddle 20 supports lever 18 and aligns the lever with its respective opening 26 formed in game board 12. Saddle 20 also provides a pivot point for lever 18. Saddle 20 may be made of any hard material known in the art, such as metal, wood or plastic, and the like. Preferably, saddle 20 is formed from either plastic or wood. Saddle 20 on which lever 18 rests must fit snuggly and can be of varying diameters to allow for smooth vertical movement of the lever. Because saddle 20 is only slightly wider than lever 18, the saddle minimizes lateral movement of the lever during operation of the lever. A pair of pins 22 serves as the means by which man game piece 26 and a man base 24 are supported. Pins 22 act as guides for man game piece 26 and man base 24 so that they move perpendicular to game board 12 when lever 18 is depressed. Pins 22 are barbed or knurled at the top which secures it as it is press-fitted into the underside of game board 12. At the bottom of the barbed section, there is a flange 54 which ensures pin 22 is inserted at the optimal depth into the underside of game board 12. A second flange 56 located at the other end of pin 22 acts as a stop for man game piece 26 and man base 24. Pin 22 is formed from plastic or other rigid material. Pin 22 is preferably about 2.14 inches in length, but could be shorter or longer without changing the overall concept of the present invention. When man game piece 26 and man base 24 rest on flange 56, the top of the man game piece is flush with the top surface 40 of game board 12. Base 24 serves as the support for man game piece 26. Base 24 is configured and designed so that when lever 18 is pressed, the base rises causing the man game piece mounted on the base to raise and protrude through its respective opening 26 in game board 12. Base 24 can be made of any hard material known in the art such as wood, plastic or metal and the like. Base 24 is preferably shaped in a rectangular fashion with a generally flat bottom, but could also be other shapes. Base 24 includes a rounded knotch 58 formed in each of its ends. Knotch 58 cooperates with pins 22 when lever 18 is depressed so that man game piece 26 is forced upwardly through game board opening 26.

Figure 11:
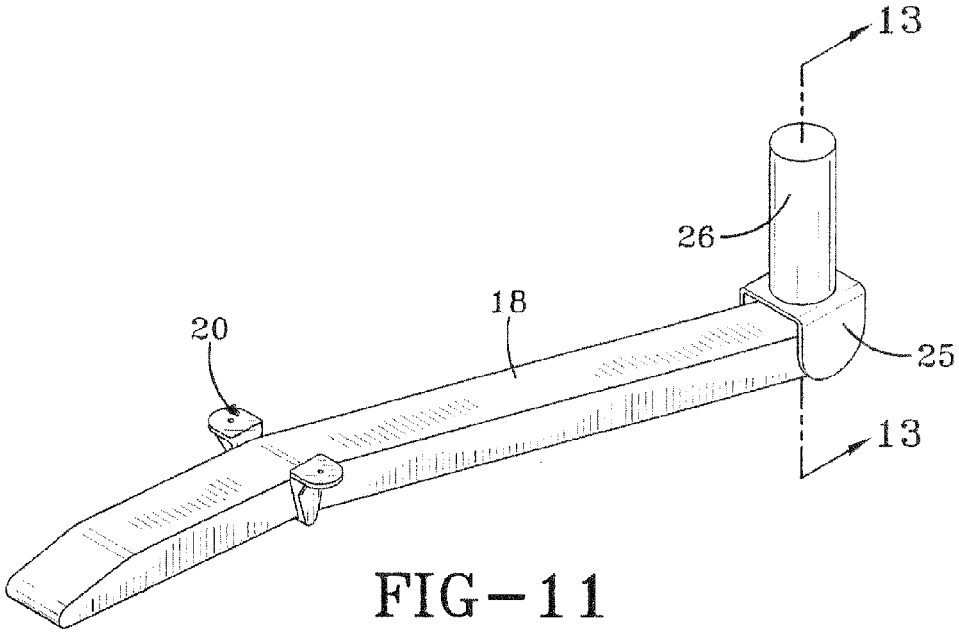
FIG. 11 is an alternative lever assembly including the base and the man game piece.
Figure 12:
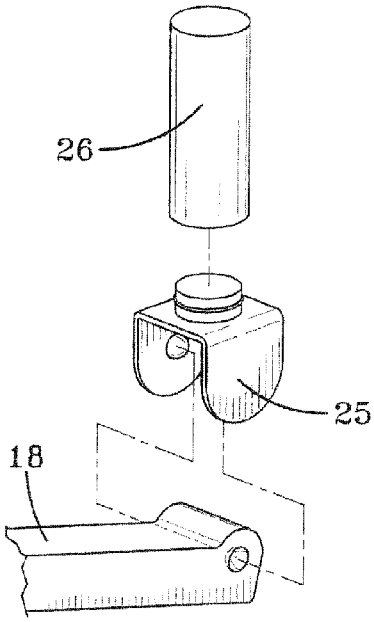
FIG. 12 is an exploded fragmentary view of the alternative lever assembly shown in FIG. 11, showing the man game piece mounting platform on the base and the dimples formed in the base that cooperate with the depressions formed in the end of the lever.
Figure 13:
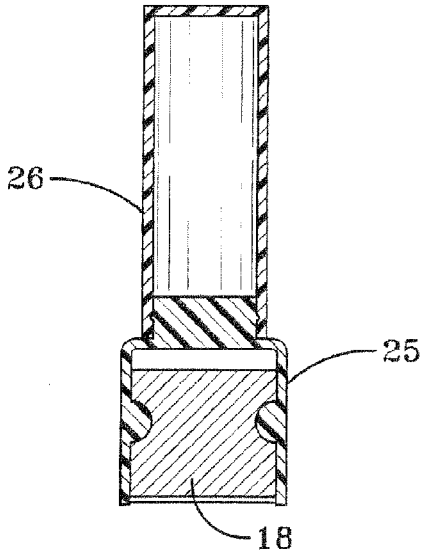
FIG. 13 is a sectional view of the man game piece, base and lever shown in FIG. 11 taken along lines 13.

Turning now to FIGS. 11-13, an alternative base 25 may be mounted directly to lever 18, eliminating the need for pins 22 and base 24. Man game piece 26 is configured preferably in the shape of a cylinder having a circular cross-section but could be any other shape, such as a square, rectangle, triangle, octagon, ellipse, etc. Man game piece 26 is made of a hard material known in the art. The height of man game piece 26 may range between about ½ inch to about 5.0 inches, but preferably is about 2.0 inches. The diameter of Man game piece 26 is sized slightly less than opening 26 in game board 12. Man game piece 26 preferably has a flat top so that when lever 18 is inactive, the top of the man game piece sits flush with game board 12.

Figure 14:
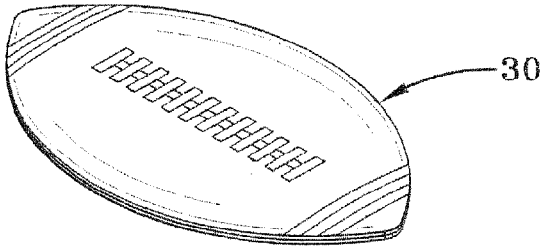
FIG. 14 is top perspective view of the ball used in connection with the tabletop sporting game apparatus of the present invention.
Figure 15A:
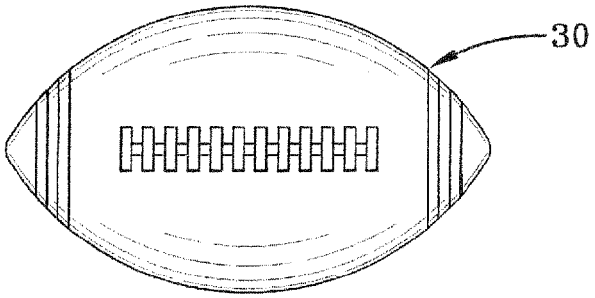
FIG. 15A is a top view of the ball shown in FIG. 14.
Figure 15B:
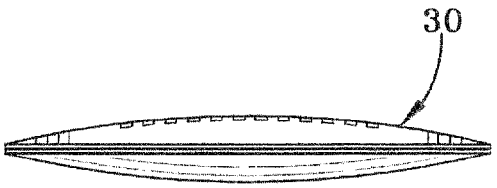
FIG. 15B is a side view of the ball shown in FIG. 14.
Figure 15C:
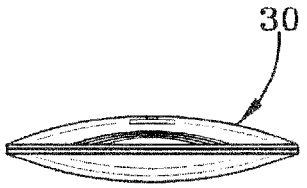
FIG. 15C is an end view of the ball shown in FIG. 14.

Turning now to FIGS. 14-15C, a ball 30 having an oblong shape with semi-pointed tips at either end, such as that of an American football, is made of any flexible material known in the art but is preferably constructed of two identically football-shaped pieces of leather. Any known connectors such as string, adhesive, staples, and the like may connect these pieces of leather. The center between the two pieces of leather is filled with any known soft, flexible material causing the center region of ball 30 to bulge slightly outwardly. Ball 30 may or may not have colored tips at either end. Ball 30 is between about 1 inch and about 4 inches from tip to tip, but is preferably about 2¾ inches from tip to tip. The width of ball 30 is from about 1 inch to 2 inches and preferably about 1⅝ inches. Ball 30 is ⅜ inch thick but could also be thicker or thinner without changing the overall concept of the present invention.

Having now described the structure of the tabletop sporting game apparatus 10 of the present invention, the operation of the invention will now be described in detail below. Ball 30 is flicked, or nudged from one end of the game board 12 toward the other end of the game board. Lever 18 is activated by depressing the end of the lever, which causes the lever to pivot on and around saddle 20. The pivoting of lever 18 urges or pushes the bottom side of man base 24 upwardly, causing the man base and man game piece 26 to slide upwardly along pins 22, thereby elevating the man game piece above game board surface 40, allowing the man game piece to block, flip, lift deflect or impede ball 30. Spaced-apart bumpers 28 keep ball 30 in the field of play during gameplay. More particularly, when a player nudges, flicks or pushes hall 30 across the playing surface, bumpers 28 cause the ball to be deflected back onto the playing surface so that the ball does not leave the field of play.

Preferred embodiment tabletop sporting game apparatus 10 is shown and described in conjunction with an American football motif, but other sports motifs are also possible such as soccer, hockey, field hockey, lacrosse, baseball and the like, which could also be utilized in conjunction with the present invention. It should be understood that preferred embodiment tabletop sporting game apparatus 10 of the present invention could be utilized with one or more openings 26 and a corresponding number of levers 18, saddles 20, man game pieces 26, man bases 24 and pins 22 without changing the overall concept or operation of the present invention. It should also be understood that preferred embodiment tabletop sporting game apparatus 10 of the present invention could be utilized with or without scoreboard 32 without changing the overall concept or operation of the present invention. It is even further understood that preferred embodiment tabletop sporting game apparatus 10 of the present invention could be utilized with or without goal posts 34 without changing the overall concept or operation of the present invention. It is contemplated that preferred embodiment tabletop sporting game apparatus 10 of the present invention could also be utilized with or without pylons 36 without changing the overall concept or operation of the present invention.

The present invention has been described with reference to a specific embodiment. It is to be understood that this illustration is by way of example and not by way of limitation. Potential modifications and alterations will occur to others upon a reading and understanding of this disclosure, and it is understood that the invention includes all such modifications and alterations and equivalents thereof.

Accordingly, the tabletop sporting game apparatus of the present invention is simplified, provides an effective, safe, inexpensive, and efficient tabletop sporting game apparatus which achieves all the enumerated objectives, provides for eliminating difficulties encountered with prior art tabletop sporting games, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the tabletop sporting game apparatus is constructed, arranged and used, the characteristics of the construction and arrangement, and the advantageous, new and useful results obtained; the new and useful structures, devices, elements, arrangements, parts and combinations, and methods are set forth in the appended claims.

What is claimed is:

1. A tabletop sporting game apparatus comprising:

a) a game board having at least one opening formed therein;

b) a pair of legs being attached to said game board, said legs elevating said game board generally off of the ground;

c) a lever disposed beneath said game board and operatively attached to an underside of said game board, said lever including an angled portion along its length, the lever communicating with a man game piece, said man game piece being disposed through said game board opening, such that when said lever is depressed, said man game piece is forced upwardly through said game board opening in order to affect the movement of a ball being moved across said game board.

2. The tabletop sporting game apparatus of claim 1 further comprising a saddle connected to said underside of said game board, said lever being operatively mounted on said saddle.

3. The tabletop sporting game apparatus of claim 1, further comprising a man base being connected to said man game piece, said man base having a pair of notches each one of said pair of notches being formed in a respective end of said man base, each one of a pair of pins being disposed through a respective one of said notches, each of said pins being attached to said underside of said game board.

4. The tabletop sporting game apparatus of claim 1, further comprising a goal post, said goal post being removably mounted on said game board.

5. The tabletop sporting game apparatus of claim 1, further comprising a scoreboard attached to said game board.

6. The tabletop sporting game apparatus of claim 1, further comprising a longitudinally extending bumper, said bumper being attached to a side edge of said game board, said bumper generally prohibiting said ball from sliding off said game board side edge.

7. The tabletop sporting game apparatus of claim 1, further comprising a pylon being attached to said game board.

8. The tabletop sporting game apparatus of claim 1, further comprising an American football indicia being printed on a top surface of said game board.

9. The tabletop sporting game apparatus of claim 1, further comprising a cross brace extending between and being connected to respective ones of said pair of legs.

10. A tabletop sporting game apparatus comprising:

a) a game board having at least one opening formed therein;

b) a pair of legs being attached to said game board, said legs elevating said game board generally off of the ground;

c) a lever operatively attached to an underside of said game board and communicating with a man game piece, said man game piece being disposed through said game board opening, such that when said lever is depressed, said man game piece is forced upwardly through said game board opening in order to affect the movement of a ball being moved across said game board; and d) a man base being connected to said man game piece, said man base having a pair of notches each one of said pair of notches being formed in a respective end of said man base, each one of a pair of pins being disposed through a respective one of said notches, each of said pins being attached to said underside of said game board.

11. The tabletop sporting game apparatus of claim 10 further comprising a saddle connected to said underside of said game board, said lever being operatively mounted on said saddle.

12. The tabletop sporting game apparatus of claim 10, further comprising a goal post, said goal post being removably mounted on said game board.

13. The tabletop sporting game apparatus of claim 10, further comprising a scoreboard attached to said game board.

14. The tabletop sporting game apparatus of claim 10, further comprising a longitudinally extending bumper, said bumper being attached to a side edge of said game board, said bumper generally prohibiting said ball from sliding off said game board side edge.

15. The tabletop sporting game apparatus of claim 10, further comprising a pylon being attached to said game board.

16. The tabletop sporting game apparatus of claim 10, further comprising an American football indicia being printed on a top surface of said game board.

17. The tabletop sporting game apparatus of claim 10, further comprising a cross brace extending between and being connected to respective ones of said pair of legs.

* * * * *